US005575034A

United States Patent [19]

Biernacinski et al.

[11] Patent Number: 5,575,034

[45] Date of Patent: Nov. 19, 1996

[54] FOOT CLEANING AND MASSAGING MAT SYSTEM

[76] Inventors: Robert D. Biernacinski, 4403-C Valley Ave., Pleasanton, Calif. 94566; Mirella M. Tomasik, 555 E. Washington Ave. #609, Sunnyvale, Calif. 94086

[21] Appl. No.: 492,185

[22] Filed: Jun. 19, 1995

[51] Int. Cl.[6] ..... A47K 7/02; A61H 7/00

[52] U.S. Cl. ..... 15/217; 15/161; 15/215; 4/581; 4/606; 601/136; 428/95

[58] Field of Search ..... 15/161, 215–217; 4/581–583, 605, 606, 657; 601/134, 136, 154, 155, 158; 428/95

[56] References Cited

U.S. PATENT DOCUMENTS

| | | | |
|---|---|---|---|
| 223,154 | 12/1879 | Lawrence | 15/216 |
| 304,433 | 9/1884 | Kleffman | 15/216 |
| 5,215,348 | 6/1993 | Wen-Hwang | 15/215 |
| 5,293,660 | 3/1994 | Park | 15/217 |

FOREIGN PATENT DOCUMENTS

| | | | |
|---|---|---|---|
| 199510 | 4/1922 | United Kingdom | 15/216 |

*Primary Examiner*—Mark Spisich

[57] ABSTRACT

A foot cleaning and massaging shower mat system comprising a mat in a generally rectangular configuration is disclosed. The mat system is comprised of an upper planar surface and a lower planar surface parallel with each other. The upper and lower surfaces are both formed in a rectangular configuration and are coupled around their periphery with an outwardly directed projection. An aperture is formed in the center of the mat and extends completely therethrough. An upwardly extending recess is formed from the lower surface of the mat peripherally around the aperture. An insert is positioned within the recess and has a plurality of apertures in a symmetric configuration. A plurality of upstanding bristle-like members extend upwardly from the upper surface of the mat between the aperture and the periphery.

3 Claims, 4 Drawing Sheets

FOOT CLEANING AND MASSAGING MAT SYSTEM

BACKGROUND OF THE INVENTION

1. Field of the Invention

The present invention relates to a foot cleaning and massaging mat system and, more particularly, pertains to simultaneously cleaning and massaging a person's feet when in the shower.

2. Description of the Prior Art

The use of devices for cleaning a user's feet or massaging them through a wide variety of designs and configurations is known in the prior art. More specifically, devices for cleaning a user's feet or massaging them through a wide variety of designs and configurations heretofore devised and utilized for the purpose of cleaning a user's feet and massaging a user's feet through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,512,044 to Clark a portable shower and bath mat.

U.S. Pat. No. 5,321,867 to Probst discloses a foot washing apparatus.

U.S. Pat. No. Des. 327,388 to Phillips discloses a bath mat.

U.S. Pat. No. Des. 328,545 to Szaro discloses an ornamental design for a bath mat.

Lastly, U.S. Pat. No. Des. 336,198 to Gibbons discloses a foot stimulating shower mat.

In this respect, the foot cleaning and massaging mat system according to the present invention substantially departs from the conventional concepts and designs of the prior art, and in so doing provides an apparatus primarily developed for the purpose of simultaneously cleaning and massaging a person's feet when in the shower.

Therefore, it can be appreciated that there exists a continuing need for a new and improved foot cleaning and massaging mat system which can be used for simultaneously cleaning and massaging a person's feet when in the shower. In this regard, the present invention substantially fulfills this need.

SUMMARY OF THE INVENTION

In view of the foregoing disadvantages inherent in the known types of devices for cleaning a user's feet or massaging them through a wide variety of designs and configurations now present in the prior art, the present invention provides an improved foot cleaning and massaging mat system. As such, the general purpose of the present invention, which will be described subsequently in greater detail, is to provide a new and improved foot cleaning and massaging mat system and method which has all the advantages of the prior art and none of the disadvantages.

To attain this, the present invention essentially comprises a new and improved foot cleaning and massaging mat system for use in a shower comprising, in combination, a mat in a generally rectangular configuration having an upper planar surface and a lower planar surface parallel with each other, the upper and lower surfaces being both in a rectangular configuration and coupled around their periphery with a triangular-shaped outwardly directed projection; an aperture in a square configuration formed in the center of the mat and extending completely therethrough; an upwardly extending recess formed from the lower surface of the mat peripherally around the aperture; an insert positionable within the recess, the insert having a plurality of square apertures in a symmetric configuration; a plurality of upstanding bristle-like members extending upwardly from the upper surface of the mat between the aperture and the periphery; and a plurality of indents formed in the lower surface of the mat within the projection.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved foot cleaning and massaging mat system which has all the advantages of the prior art devices for cleaning a user's feet or massaging them through a wide variety of designs and configurations and none of the disadvantages.

It is another object of the present invention to provide a new and improved foot cleaning and massaging mat system which may be easily and efficiently manufactured and marketed.

It is a further object of the present invention to provide a new and improved foot cleaning and massaging mat system which is of a durable and reliable construction.

An even further object of the present invention is to provide a new and improved foot cleaning and massaging mat system which is susceptible of a low cost of manufacture with regard to both materials and labor, and which accordingly is then susceptible of low prices of sale to the consuming public, thereby making such devices for cleaning a user's feet or massaging them through a wide variety of designs and configurations economically available to the buying public.

Still yet another object of the present invention is to provide a new and improved foot cleaning and massaging mat system which provides in the apparatuses and methods of the prior art some of the advantages thereof, while simultaneously overcoming some of the disadvantages normally associated therewith.

Even still another object of the present invention is to simultaneously clean and massage a person's feet when in the shower.

Lastly, it is an object of the present invention to provide a foot cleaning and massaging shower mat system comprising a mat in a generally rectangular configuration. The mat system is comprised of an upper planar surface and a lower planar surface parallel with each other. The upper and lower surfaces are both formed in a rectangular configuration and are coupled around their periphery with an outwardly directed projection. An aperture is formed in the center of the mat and extends completely therethrough. An upwardly extending recess is formed from the lower surface of the mat peripherally around the aperture. An insert is positioned within the recess and has a plurality of apertures in a symmetric configuration. A plurality of upstanding bristle-like members extend upwardly from the upper surface of the mat between the aperture and the periphery.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
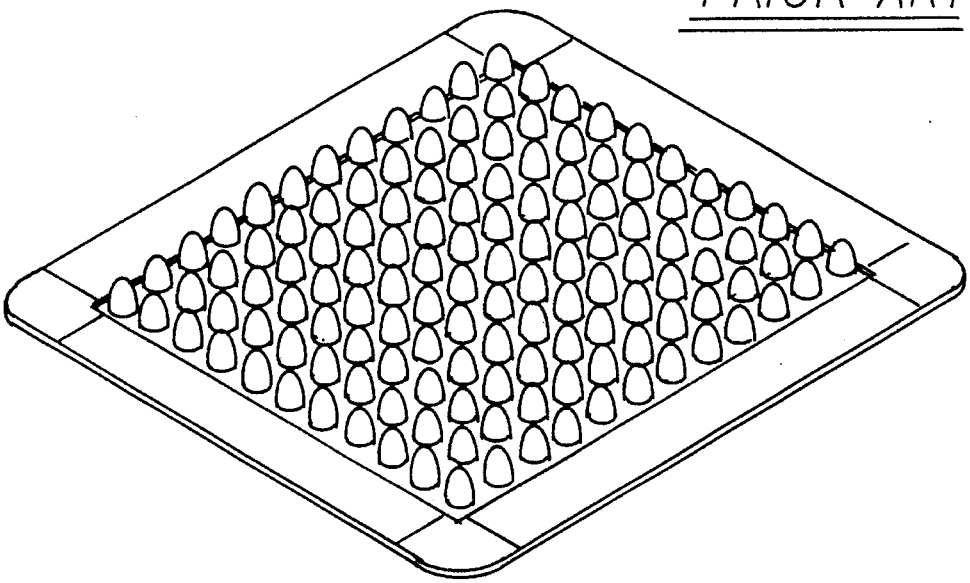
FIG 1 PRIOR ART
FIG. 1 is a perspective illustration of a prior art foot cleaning and massaging mat system constructed in accordance with a prior art design.
Figure 2:
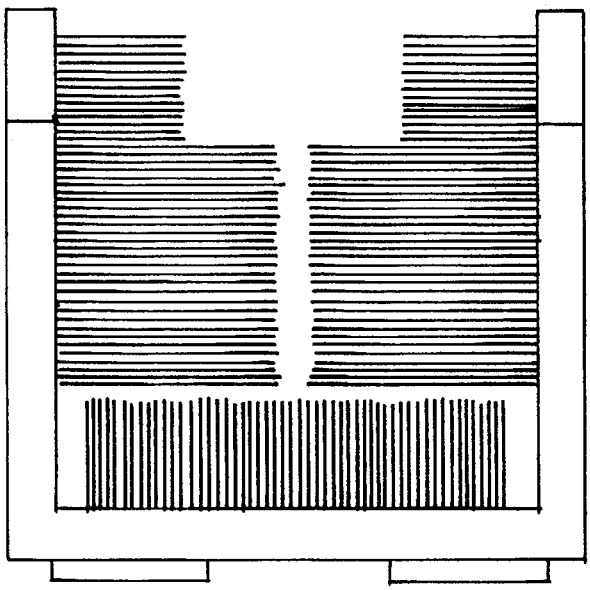
FIG 2 PRIOR ART
FIG. 2 is an elevational illustration of another prior art foot cleaning and massaging mat system.
Figure 3:
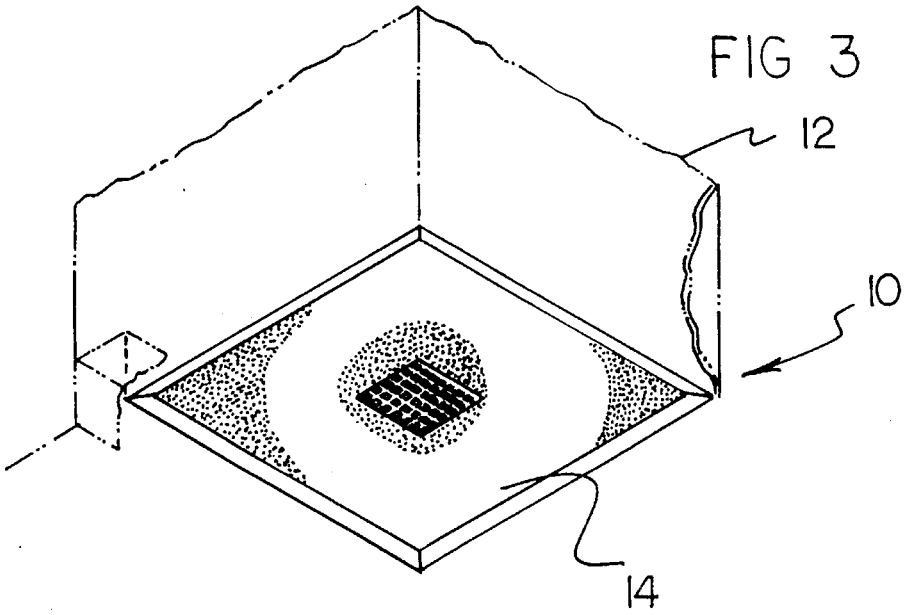
FIG. 3 is a perspective illustration of the present invention in use.
Figure 4:
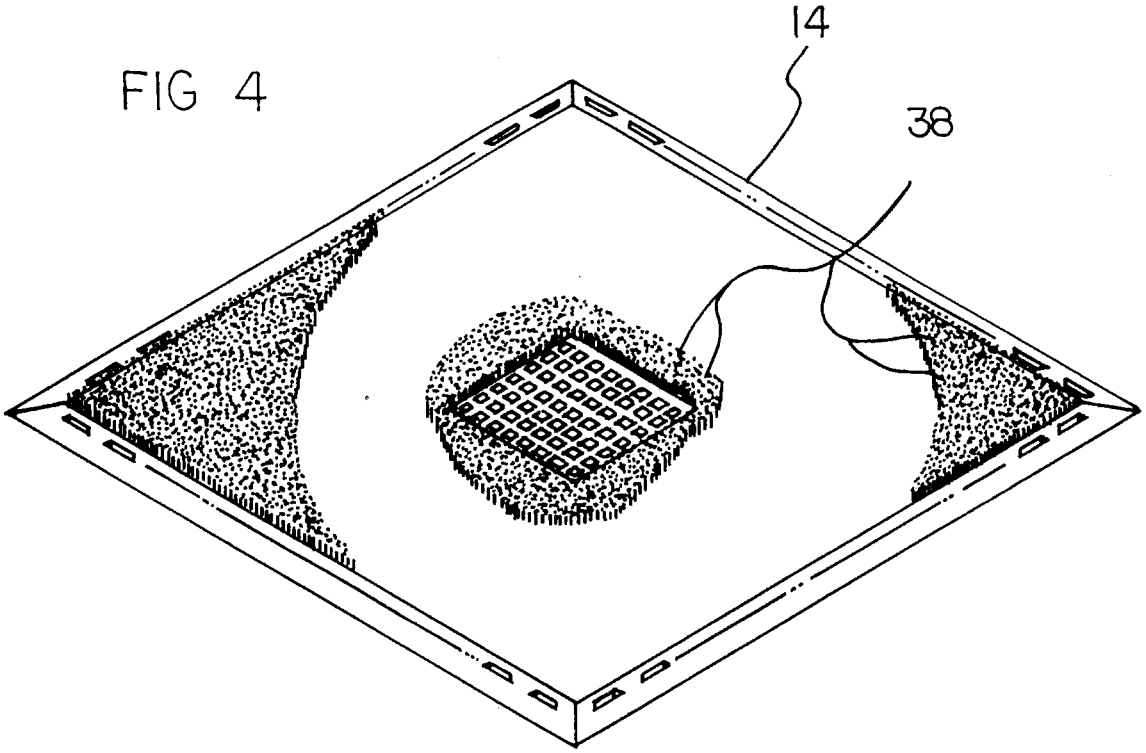
FIG. 4 is an enlarged perspective illustration of the present invention.
Figure 5:
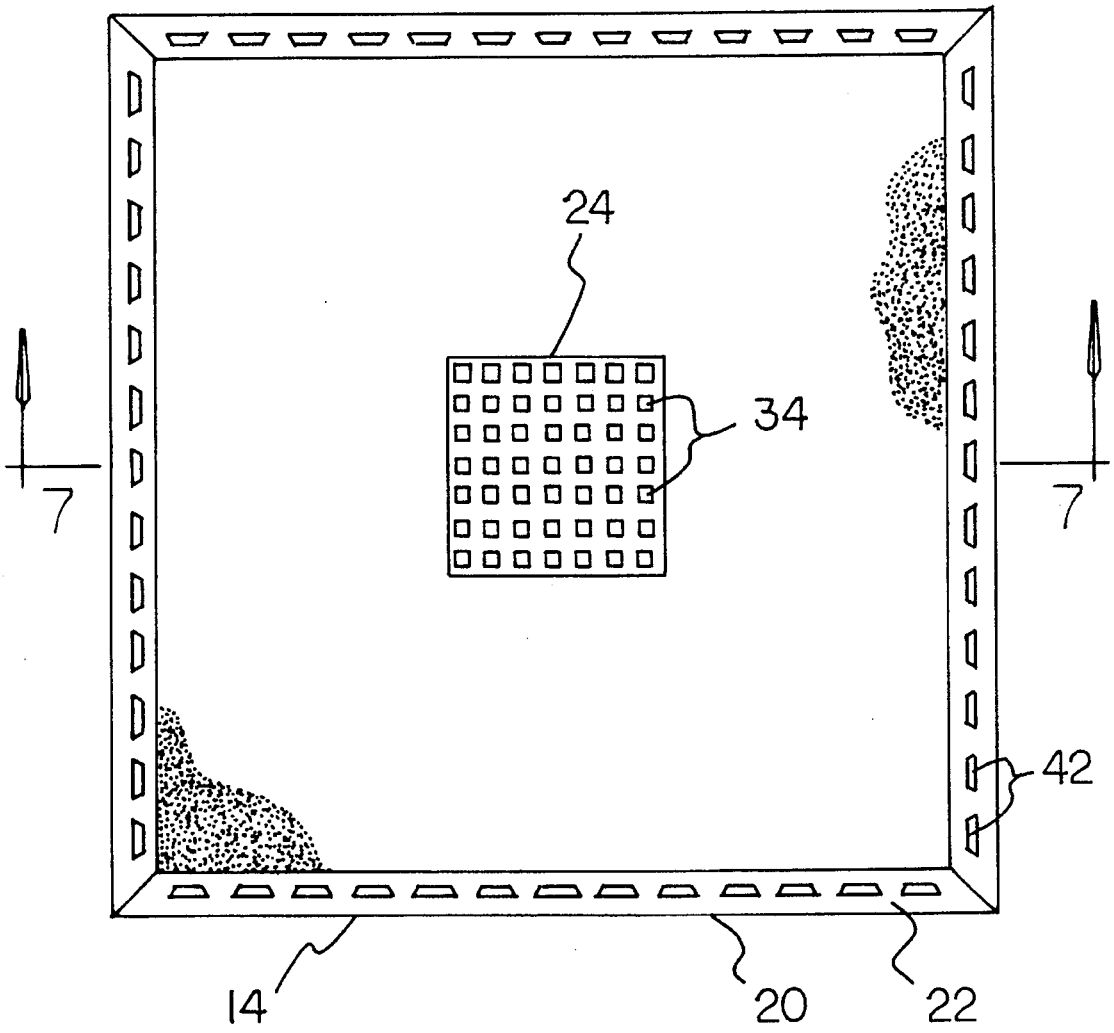
FIG. 5 is a plan illustration of the present invention.
Figure 6:
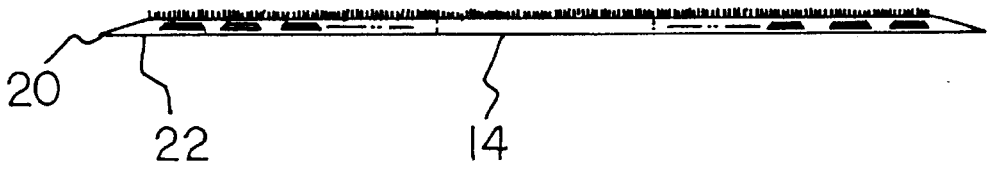
FIG. 6 is an elevational illustration of the present invention.
Figure 7:
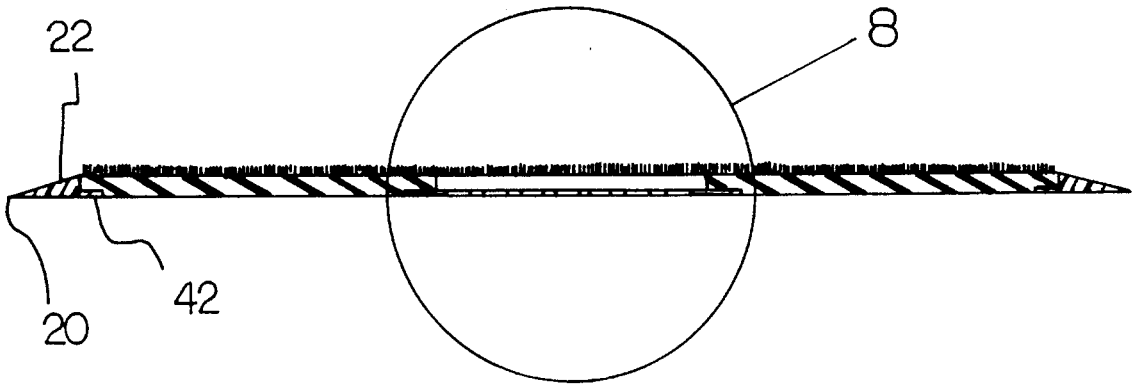
FIG. 7 is a sectional illustration of the present invention.
Figure 8:
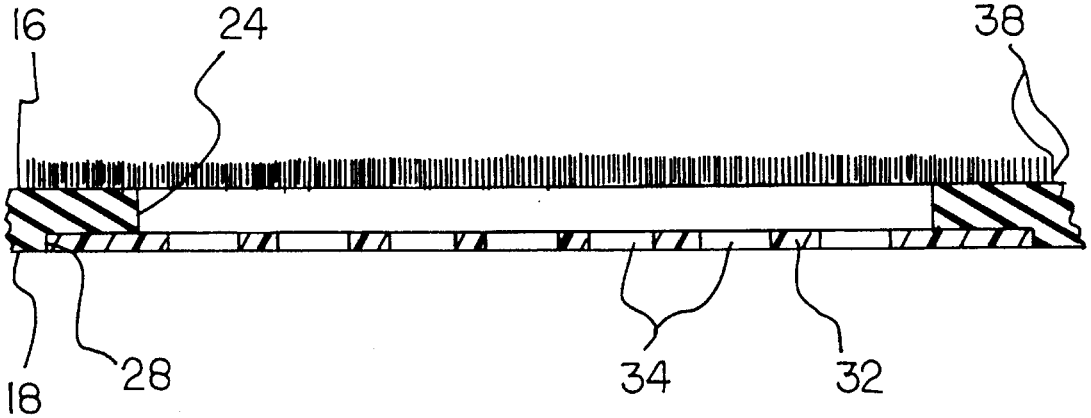
FIG. 8 is an enlarged sectional illustration as indicated in FIG. 7.

With reference now to the drawings, and in particular to FIG. 1 thereof, the preferred embodiment of the new and improved foot cleaning and massaging mat system embodying the principles and concepts of the present invention and generally designated by the reference numeral 10 will be described.

The present invention, the new and improved foot cleaning and massaging mat system, is a system 10 comprised of a plurality of components. In their broadest context, the components include a mat, an aperture, a recess, an insert, bristle-like members and indents. Each of the individual components is specifically configured and correlated one with respect to the other so as to attain the desired objectives.

More specifically, the central component of the system 10 of the present invention, a system adapted for use in a shower 12, is a mat 14. Such mat is fabricated in a generally rectangular configuration. It has an upper planar surface 16. It also has a lower planar surface 18. The upper and lower planar surfaces are parallel with respect to each other. The upper and lower surfaces are both in a rectangular configuration. Coupled around their periphery 20 is a triangularly-shaped, outwardly-directed projection 22. The triangular is a right triangle with a lower surface parallel with the lower surface of the mat and its upper surface angled downwardly from the upper horizontal edge of the mat.

The next component of the system 10 is an aperture 24. Such aperture is in a square configuration. It is formed in the center of the mat. It extends completely through the mat.

Formed with respect to the aperture in the mat is an upwardly extending recess 28. Such recess is formed from the lower surface of the mat. It extends peripherally around the aperture 24 of the mat.

Located within the recess 28 is an insert 32. The insert is positioned within the recess and coupled with respect thereto. Such insert has a plurality of square apertures 34. The apertures are oriented in a symmetric configuration, parallel rows and columns in the preferred embodiment.

Next provided are a plurality of upstanding bristle-like members 38. Such bristle-like members have lower ends secured to the mat and upper free ends. They extend upwardly from the upper surface of the mat between the periphery of the aperture and the periphery of the mat.

The last component of the system 10 are a plurality of indents 42. Such indents are formed in the lower surface of the mat within the projection 22. Such indents assist in precluding inadvertent movement of the mat within the shower during operation and use.

The entire mat including the projection and insert is preferably fabricated of a rubber or plastic material, natural or synthetic or blends thereof, whereby it will have a long life when in a water-ladened embodiment such as a shower.

The concept of the present invention comprises a mat for use in the shower to clean and massage the feet of a user without having to bend over to reach them. The mat is square, and is constructed of durable plastic and rubber materials. It measures 29 inches on a side, and has tapered edges around the entire perimeter. The edges are plastic and form a frame for the center section which is made of rubber material. The surface of this inner section has short bristles covering the entire surface except for the center of the mat, which has a plastic square seven inches on a side. It is perforated with square holes spaced at even intervals to form an open grid to allow water to easily drain from its surface. The bottom surface is slip-resistant to maintain the mat securely in position while in use.

The present invention can be used in shower stalls or in the bathtub. The person who is showering stands on the mat and rubs the soles of his/her feet on the surface. The short bristles effectively clean all of the cracks and crevices, and will also remove much of the dead skin and softened callouses. It eliminates attempting to stand on one foot while scrubbing the other.

Everyone will enjoy the benefits of this mat, but especially people who have back problems, or those who find it difficult to bend down or lift one foot. It provides a relaxing and exhilarating feeling while giving a gentle massage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved foot cleaning and massaging mat system for use in a shower comprising, in combination:

a mat in a generally rectangular configuration having an upper planar surface and a lower planar surface parallel with each other, the upper and lower surfaces being both in a rectangular configuration and coupled around their periphery with a triangular-shaped outwardly directed projection;

an aperture in a square configuration formed in the center of the mat and extending completely therethrough;

an upwardly extending recess formed from the lower surface of the mat peripherally around the aperture;

an insert positionable within the recess, the insert having a plurality of square apertures in a symmetric configuration;

a plurality of upstanding bristle-like members extending upwardly from the upper surface of the mat between the aperture and the periphery; and a plurality of indents formed in the lower surface of the mat within the projection.

2. A foot cleaning and massaging shower mat system comprising:

a mat in a generally rectangular configuration having an upper planar surface and a lower planar surface parallel with each other, the upper and lower surfaces being both in a rectangular configuration and coupled around their periphery with an outwardly directed projection;

an aperture formed in the center of the mat and extending completely therethrough;

an upwardly extending recess formed from the lower surface of the mat peripherally around the aperture;

a substantially flat and planar insert positionable within the recess, the insert having a plurality of apertures in a symmetric configuration; and a plurality of upstanding bristle-like members extending upwardly from the upper surface of the mat between the aperture and the periphery.

3. The system as set forth in claim 2 and further including:

a plurality of indents formed in the lower surface of the mat within the projection.

* * * * *